US006053387A

United States Patent [19]

Garbotz et al.

[11] Patent Number: 6,053,387

[45] Date of Patent: Apr. 25, 2000

[54] STRAP DRIVING DEVICE FOR LOOPING MACHINES

[75] Inventors: Uwe Garbotz, Bayreuth; Stefan Ries, Goldkronach, both of Germany

[73] Assignee: SMB Schwede Maschinenbau GmbH, Germany

[21] Appl. No.: 09/109,611

[22] Filed: Jul. 2, 1998

[30] Foreign Application Priority Data

Jul. 22, 1997 [DE] Germany ..... 197 31 383

[51] Int. Cl.[7] ..... B65H 20/00; B65H 23/06; B31F 1/07

[52] U.S. Cl. ..... 226/49; 100/4; 100/32; 226/100; 226/124; 226/143; 226/150; 226/155

[58] Field of Search ..... 242/11, 49, 100, 242/108, 124, 128, 143, 150, 155, 188; 100/4, 26, 29, 32; 254/266, 333

[56] References Cited

U.S. PATENT DOCUMENTS

| | | | |
|---|---|---|---|
| 3,183,824 | 5/1965 | Cook | 100/4 |
| 3,232,217 | 2/1966 | Harmon et al. | 100/4 X |
| 3,536,430 | 10/1970 | Kurihara | 100/4 |
| 3,577,909 | 5/1971 | Takano et al. | 100/4 |
| 3,906,851 | 9/1975 | Clark et al. | 100/4 |
| 4,683,017 | 7/1987 | Figiel et al. | 100/4 X |
| 5,299,407 | 4/1994 | Schuttler et al. | 100/26 X |
| 5,467,701 | 11/1995 | Bartzick et al. | 100/26 X |

FOREIGN PATENT DOCUMENTS

| | | |
|---|---|---|
| 0005508 | 11/1979 | European Pat. Off. . |
| 0321623 | 6/1989 | European Pat. Off. . |
| 2319378A1 | 12/1973 | Germany . |
| 3300039A1 | 7/1983 | Germany . |
| 3249559C2 | 10/1987 | Germany . |
| 3818526A1 | 12/1988 | Germany . |
| 3820569A1 | 12/1988 | Germany . |
| 3812626C2 | 2/1993 | Germany . |
| 4232199A1 | 4/1993 | Germany . |
| 4313420A1 | 10/1994 | Germany . |
| 19523274A1 | 1/1997 | Germany . |
| 19536964A1 | 4/1997 | Germany . |

*Primary Examiner*—Michael R. Mansen
*Attorney, Agent, or Firm*—Robert F. I. Conte; Lee, Mann, Smith, McWilliams, Sweeney & Ohlson

[57] ABSTRACT

A strap driving device for looping machines has with a strap guiding channel for a looping strap and two pairs of drive rollers engaging in the strap guiding channel. Each pair of drive rollers has a driving roller driven in rotation and a pressing roller to be set to the latter for free running. For being set to the driving roller, the pressing roller is mounted on a rocker.

14 Claims, 8 Drawing Sheets

STRAP DRIVING DEVICE FOR LOOPING MACHINES

BACKGROUND OF THE INVENTION

1. Field of the Invention

The invention relates to a strap driving device as it is used in particular in looping machines.

2. Background Art

In particular when used in looping machines, a looping strap driving device of the generic type should offer the possibility of prompt activation and deactivation. This provides for the prerequisite that the switch-over from insertion to withdrawal of the looping strap for the latter to fit around the product stack to be looped can be carried out in a short time.

Fundamentally, a plurality of solutions in terms of constructional details is known for strap driving devices. For instance, reference can be made to EP 0 005 508 A2 or DE 32 49 559 C2. These known variants are based on a common principle as regards the arrangement of the drive rollers. These are cylindrical bodies of revolution which are oriented such that a gap is available between their surface areas, through which the strap passes in its flattened position. The drive rollers act on the two main surfaces of the looping strap through frictional engagement by their surface areas so that the looping strap is transported by rotation of the drive rollers. In this case it is basically possible to drive both rollers synchronously and in opposite directions as in the case of the strap driving device according to EP 0 005 508 A2. By alternative it is also possible that only one of the two rollers is driven actively. The second roller functions as a co-rotating pressing roller as is the case with the looping strap advancing and tensioning device according to DE 32 49 559 C2.

The strap driving device according to DE 195 36 964 A1 is based on a deviating principle. In this case drive rollers are used for the transmission of a high driving power, the surface areas of which are provided with a continuous key groove. The looping strap frictionally engages with this key groove by its respectively allocated lateral edges.

DE 32 49 559 C2 mentioned above teaches a strap driving device having an advance and withdrawal wheel driven in rotation and disposed stationarily on the machine; a tensioning wheel mounted to be driven in rotation on a pivot lever; and a co-rotating pressing roller rotatably mounted on a rocker. Triggering the drives of the advance and withdrawal wheel on the one hand and the tensioning wheel on the other and corresponding spring-loading of the pivot lever and the rocker during the insertion of the looping strap as well as during its withdrawal and tightening helps attain a comparatively complex way of operation. Trouble-free functioning then depends on an accurate adjustment of various constructional elements such as spring-loads, limit stops etc. In this regard, the design and adjustment of this strap driving device are complicated. Furthermore, an advance and withdrawal wheel as well as a tensioning wheel are provided for strap driving, both of them cooperating with a single co-rotating pressing roll. In this regard, the advance and withdrawal wheel on the one hand and the tensioning wheel on the other hand are disposed at different circumferential positions of the pressing roll so that the way of the looping strap through the strap driving device takes a strongly curved, S-shaped course. This complicates the threading of the strap considerably and experience has shown that this gives rise to troubles in the passage of the strap.

SUMMARY OF THE INVENTION

It is an object of the invention to embody a strap driving device in such a way that it is constructionally simple in design, but possesses high working reliability.

This object is attained by a strap driving device comprising a strap guiding channel for the looping strap, and at least one pair of drive rollers, which engages in the strap guiding channel and has a driving roller driven in rotation and a pressing roller to be set to the latter for free running, the driving roller being stationary and the pressing roller being mounted on a rocker for the purpose of being set to the driving roller. Accordingly, the basic concept of the strap driving device only provides for a stationary driving roller driven in rotation and a pressing roller which cooperates therewith and, for being set to the driving roller, is mounted on a rocker.

By contrast to the prior art, a single pair of drive rollers is used for advancing, withdrawing and tightening the looping strap, between which the strap can be piloted in a straight line. It is further of advantage that only one rocker needs corresponding actuation for the pressing roller to be set to the driving roller.

Based on this fundamental structure of a strap driving device according to the invention, varying concepts and power stages of the strap driving device can be put into practice. For instance, in a high-speed version, two pairs of drive rollers can be provided, each having separate driving rollers and pressing rollers, the pressing rollers being disposed on a joint rocker for alternate setting. Preferably, both driving rollers are driven permanently in opposite senses of rotation.

In the case of such a configuration, reversing the strap between insertion and withdrawal is only effected through the two pressing rollers being alternately set to the in each case associated driving roller, to which end the rocker only has to be transferred from one stop position into the other stop position.

For controlled braking of the strap between insertion and withdrawal to be possible, the rocker can have a strap braking means which is also a restoring means, exercising a double function. This combined restoring and strap braking means simultaneously lifts the looping strap off the in each case active driving roller and moves the rocker into a neutral position in which, while the looping strap is braked, none of the pressing rollers acts on the looping strap. An advantage resides in that, owing to the combined restoring and strap braking means, the rocker need not be provided with any pre-stressing elements such as screws, springs or the like. Only piston-cylinder drives working in opposite directions are provided for alternate actuation of the rocker.

By advantage, also the braking plungers provided in accordance with a preferred embodiment can be actuated by a piston-cylinder drive.

In a simpler version, the strap driving device is provided with a rocker that is permanently actuated in one direction so that the pressing roller is durably set to the associated driving roller. The function of insertion and withdrawal of the looping strap can be fulfilled by reversing actuation of this driving roller. In this context it is important that the various versions can be realized, using one and the same basic structure of a rocker, which will become apparent from the description of the exemplary embodiments.

Further preferred embodiments of the strap driving device relate to a strap scanner integrated therein which detects the presence of a looping strap. So as to avoid any repetitions, reference is made in this regard to the discussion of the exemplary embodiments.

Further features, details and advantages of the invention will become apparent from the ensuing description of exemplary embodiments of the subject matter of the invention, taken in conjunction with the drawings.

DESCRIPTION OF THE PREFERRED EMBODIMENTS

Figure 1:
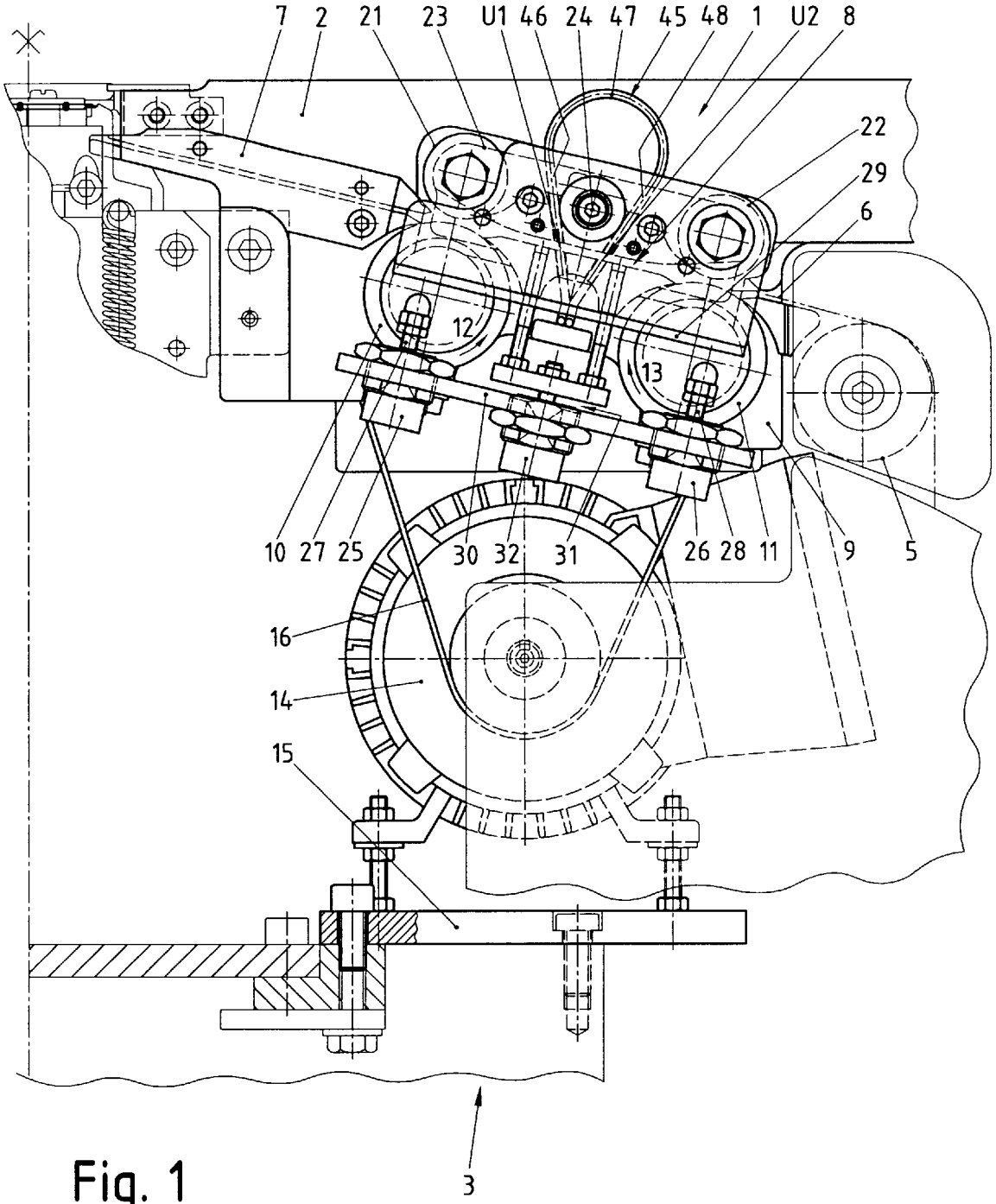
FIGS. 1 and 2 are a front and a rear view of a first embodiment of a strap driving device in a condition when mounted in a looping machine.
Figure 2:
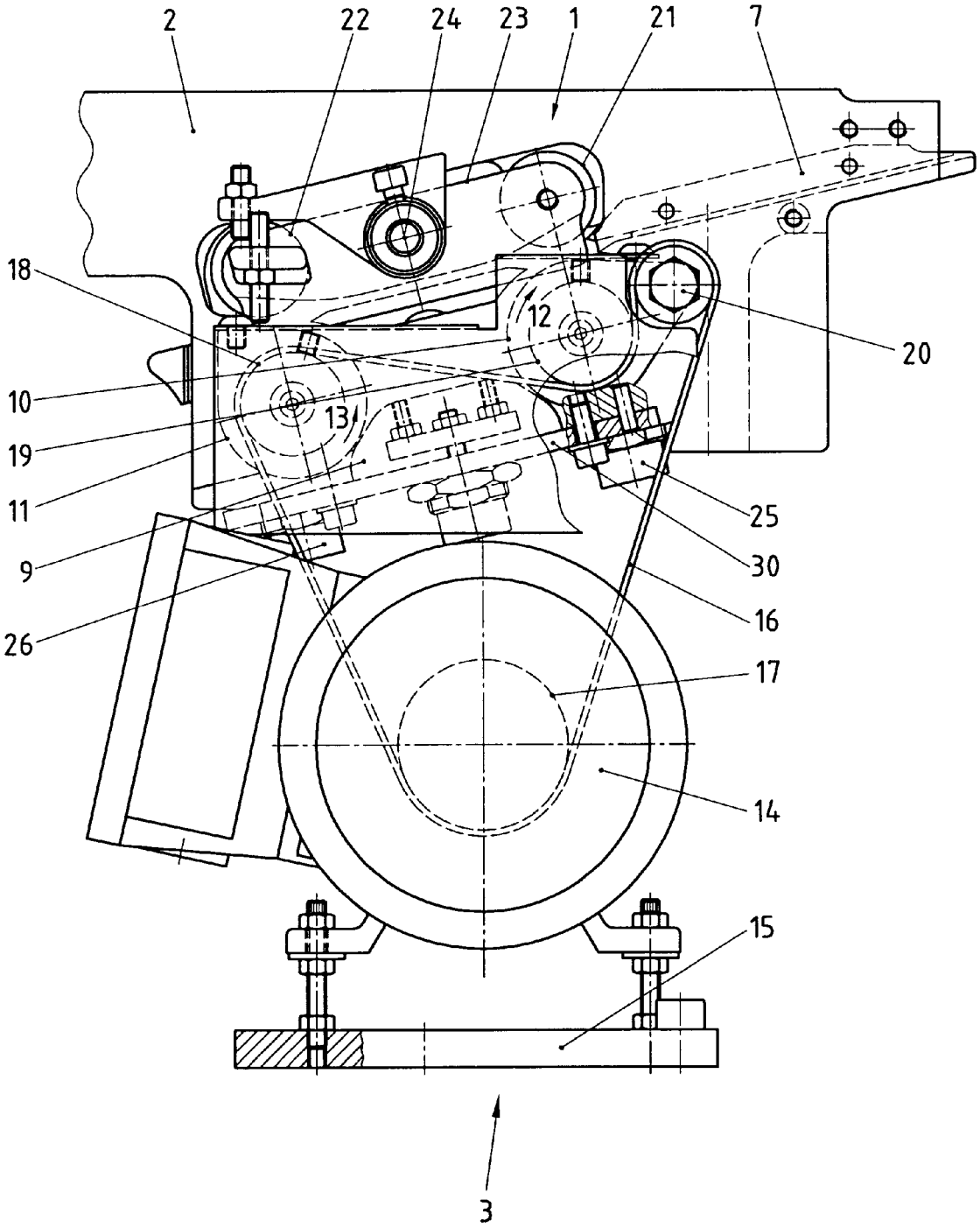

The version seen in FIGS. 1 to 5 of a strap driving device is suitable for looping machines having very high numbers of cycles, since it allows a rapid change between insertion and withdrawal of the looping strap. To this end the following design is put into practice:

Fundamentally, the strap driving device 1 is fixed several times on a machine frame 3 underneath a work table 2, only parts of the machine frame 3 being shown in FIGS. 1 and 2. Via suitable and customary guidances, such as a strap guiding roll 5 and strap channel sections 6, 7, a looping strap 4 (FIGS. 3 to 5) is delivered to the strap driving device 1 and led away from the latter. So the strap channel section 7 leads from the strap driving device 1 to the welding head of the looping machine.

In the strap driving device 1 itself, provision is made for a strap guiding channel 8 through which the looping strap 4 is guided.

The strap driving device 1 comprises two drive rollers 10, 11 which are stationarily mounted for rotation on a support member 9 and which, at two positions spaced apart from each other, engage peripherally and successively with the strap guiding channel 8. The two drive rollers 10, 11 are permanently driven in opposite directions of rotation 12, 13 by an electric motor 14 which is flanged to a frame bar 15 of the machine frame 3. Transmission between the electric motor 14 and the drive rollers 10, 11 takes place via a continuous belt 16 which—as seen in FIG. 2—coming from the driven roller 17 of the electric motor 14 is guided over the top of a first coupling roller 18 non-rotatably joined to the drive roller 11 and from there over the bottom of a second coupling roller 19 non-rotatably joined to the drive roller 10. So as to ensure an angle of contact of the belt 16 around the coupling roller 19 of slightly more than 90°, provision is made for a deflection roller 20 along which the belt 16 returns to the driven roller 17 of the electric motor 14. Owing to the S-shaped passage of the belt between the coupling rollers 18, 19, the drive rollers 10, 11 joined thereto have the mentioned opposite directions of rotation 12, 13.

For frictionally engaged contact to be obtained between the looping strap 4 and in each case one of the two drive rollers 10, 11, pressing rollers 21, 22 are allocated to the drive rollers 10, 11. These pressing rollers 21, 22 are opposite the drive rollers 10, 11 and are mounted for rotation and free running on a joint rocker 23. The rocker 23 is pivotal about an axis of rotation 24. The pivoting motion of the rocker 23 is produced by two piston-cylinder drives 25, 26 which act on the rocker 23 at each of the latter's ends and the piston rods 27, 28 of which actuate a folded edge 29 of the rocker 23 in the form of a substantially flat plate. The piston-cylinder drives 25, 26 themselves are fixed to a cross member 30 of the machine frame 3. Their pneumatic control conduits are omitted in all the drawings for reasons of clarity.

Furthermore, a combined restoring and strap braking means 31 for the rocker 23 and the looping strap 4 is integrated in the strap driving device 1, comprising a third piston-cylinder drive 32, which is disposed centrally between the two piston-cylinder drives 25, 26, two braking plungers 33, 34 and a braking jaw 35. The two braking plungers 33, 34 are disposed symmetrically to a plane of symmetry 37 which runs through the axis of rotation 24 vertically to the strap traveling plane 36. They are run in two guides 38, 39 in the stationary flank member 40, the top side 41 of which defines the strap guiding channel 8 in the vicinity of the strap driving device. By way of a cross bar 42, the two braking plungers 33, 34 are jointly fixed to the piston rod 43 of the piston-cylinder drive 32 so that they are synchronously displaceable in their guides 38, 39 at right angles to the strap traveling plane 36.

On its top side, the strap guiding channel 8 is defined by another flank member in the form of the braking jaw 35 which is mounted on the rocker 23 and cooperates with the braking plungers 33, 34 in a manner still to be explained.

Furthermore, a strap scanner is integrated in the strap driving device 1 so as to detect the presence of a looping strap 4. The strap scanner is embodied as a light barrier, guidance from the emitter via a contact breaker gap to the sensor not being open, but taking place via a light guide 45 which is illustrated in FIGS. 1 to 5. The virtual light barrier unit comprising the emitter and sensor is not shown in the drawings. It is sufficient to illustrate the course of the light guide 45. The latter's leg 46 which comes from the light barrier unit runs through the flank member 40 and is interrupted in the vicinity of the strap guiding channel 8. This is where a first breaker gap U1 is formed for the detection of a looping strap located therebetween. The leg 46 passes into a bow 47 above the strap driving device 1 and into the returning leg 48 of the light guide 45. This leg 48 is again interrupted in the vicinity of the strap guiding channel, thus forming a second breaker gap U2. As compared to a single breaker length, this double interruption leads to higher attenuation of the working beam guided in the light guide 45 in case opaque or transparent looping straps are used so that the strap scanner shown is suitable also for these types of strap which otherwise are difficult to detect. Moreover it is emphasized that the sections of the light guide 45 located in the portion above the strap guiding channel 8 are fixed in bore-holes of the braking jaw 35. The displacements, perceivable in a comparison of FIGS. 3 to 5, of the lengthwise axes of the light guides in the vicinity of the breaker lengths U1 and U2, which are occasioned by the tilting of the rocker 23, are not so serious as to affect the functioning of the optical scanner.

Figure 3:
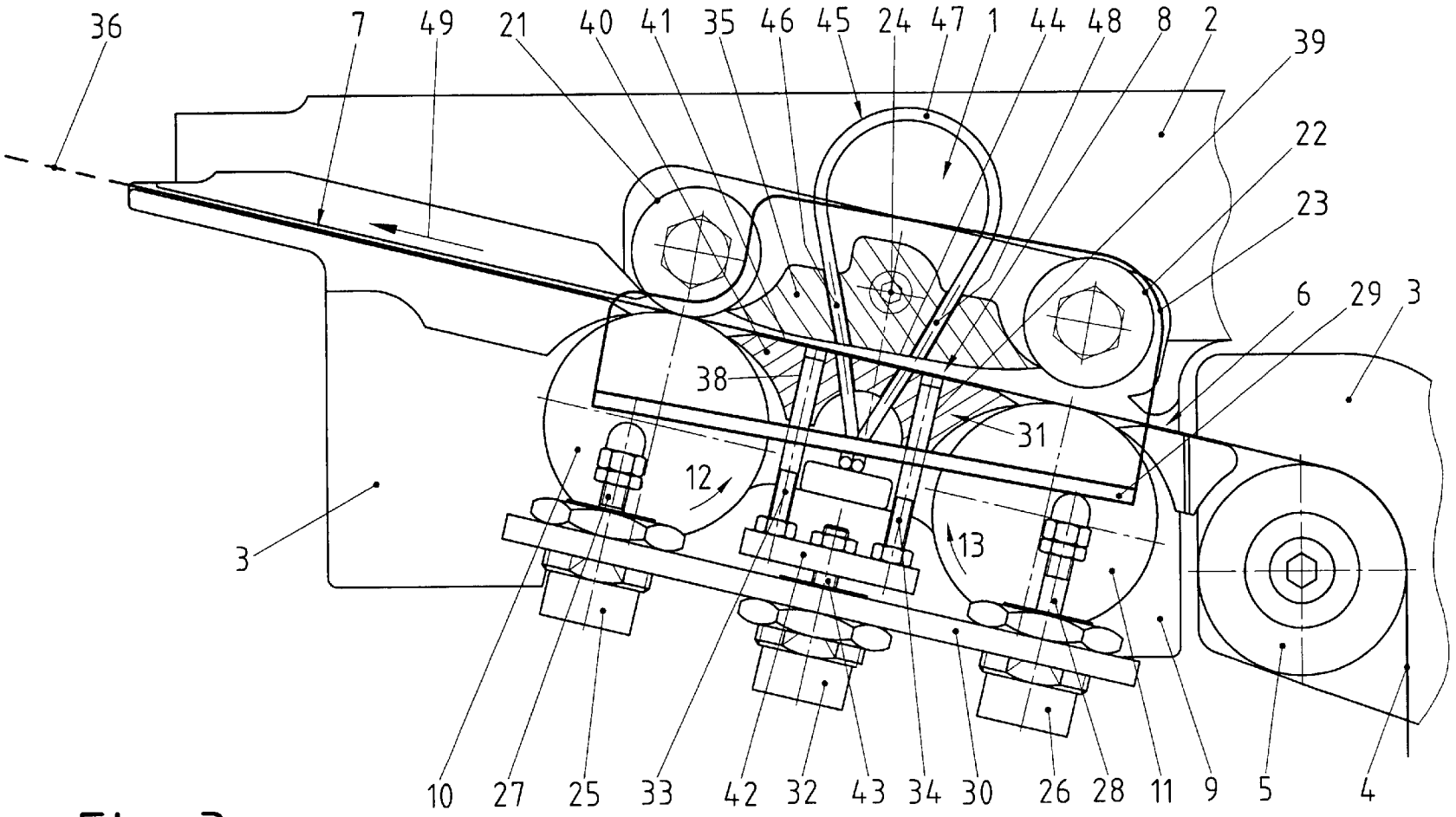
FIGS. 3 to 5 are lateral detail views, on an enlarged scale, of the strap driving device in successive positions of operation.
Figure 4:
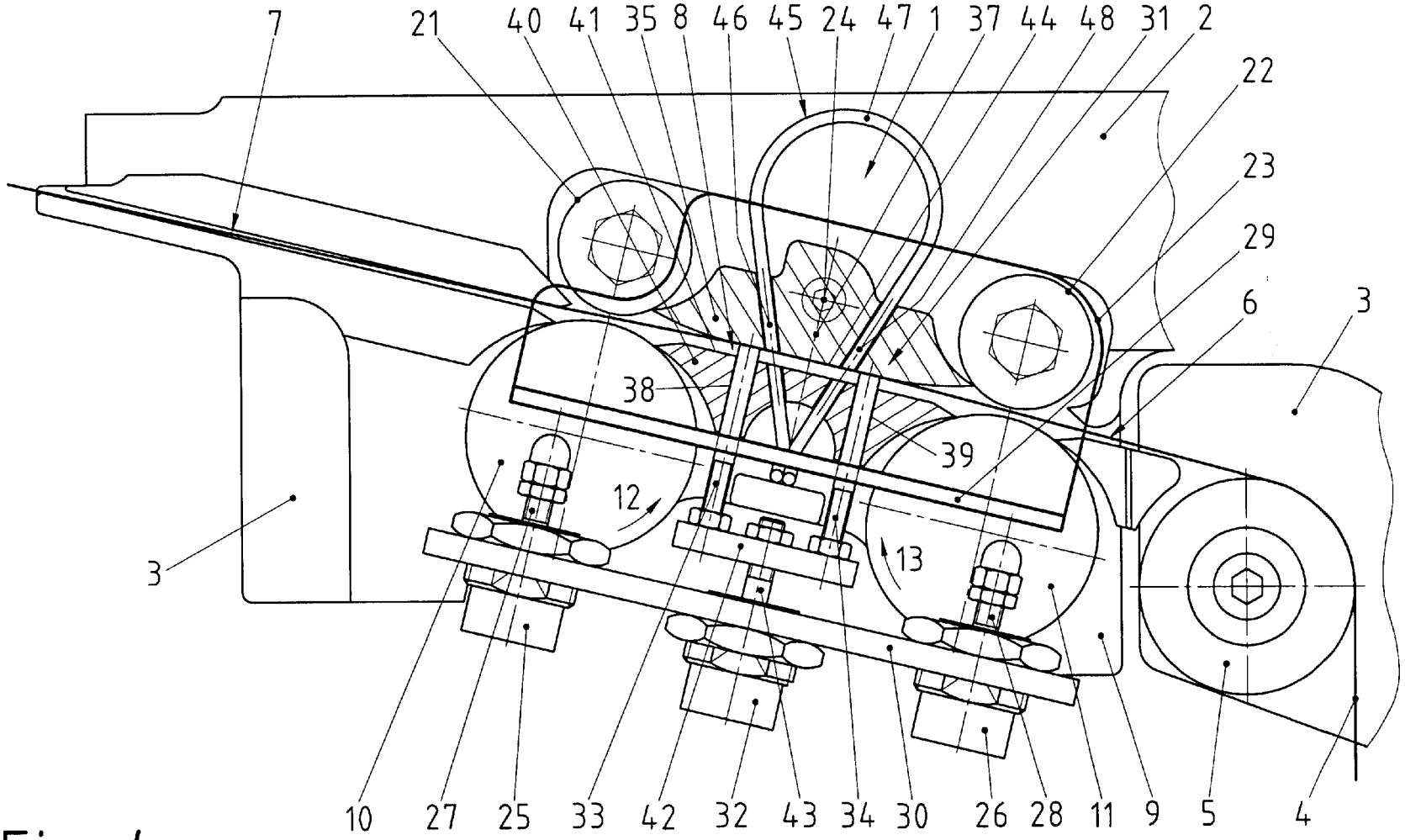
Figure 5:
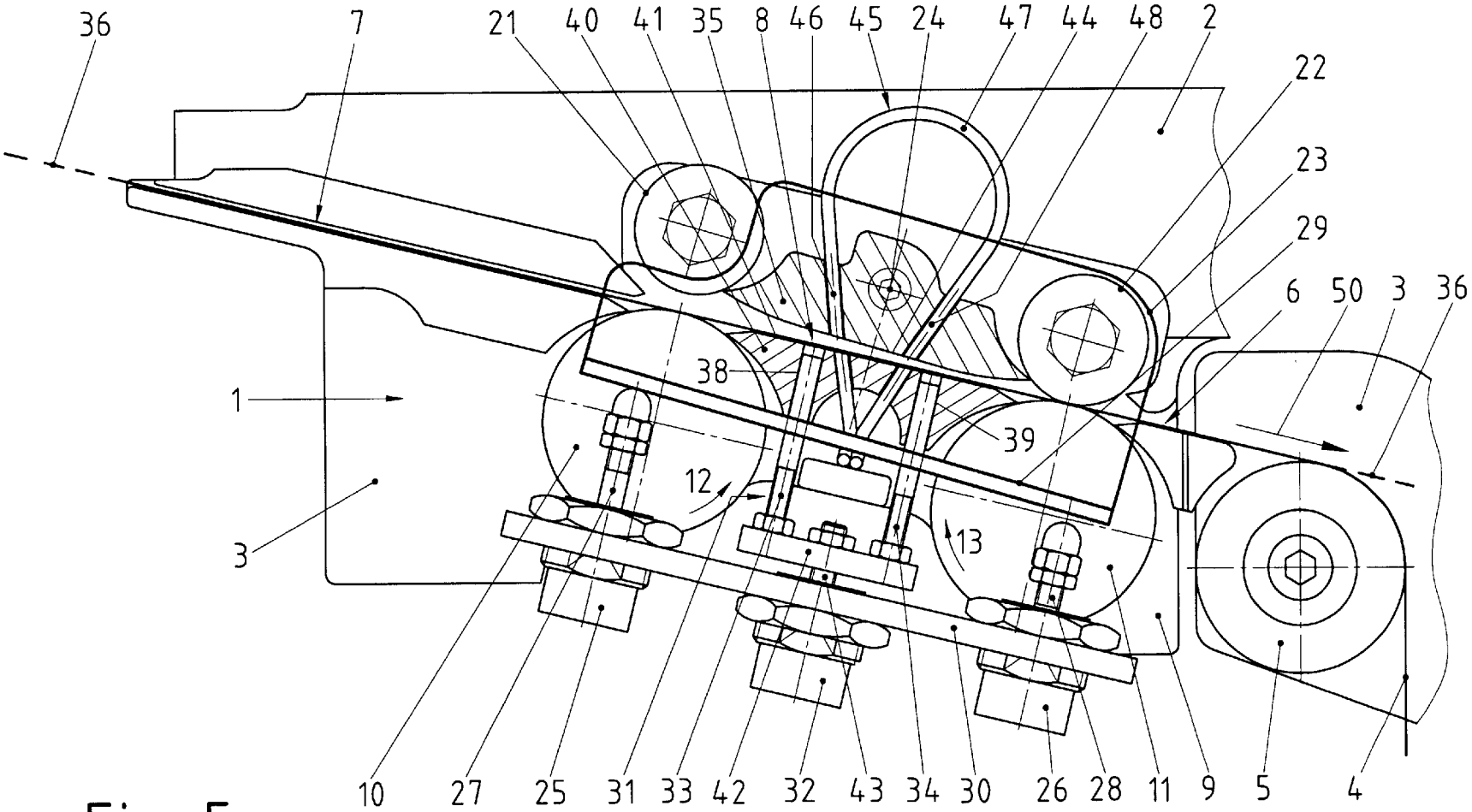

Based on FIGS. 3 to 5, the way of operation of the belt driving device is explained.

For the insertion of a looping strap 4 into the strap guiding frame of a looping machine, the looping strap 4 reaching through the strap guiding channel 8 and the strap channel sections 6, 7, the rear piston-cylinder drive 26 is extended and the front piston-cylinder drive 25 is retracted. As a result, the rocker 23 is tilted counter-clockwise and the pressing roller 21 is pressed against the associated driving roller 10. Since the latter is permanently driven in the direction of rotation 12, the looping strap 4 is transported in the direction of insertion 49 (FIG. 3). Advance rates in the range of several meters per second are usual.

As soon as the leading end of the looping strap 4 has entered the welding head (not shown), the advance of the strap must be stopped as quickly as possible and the looping strap 4 must be braked additionally. To this end, the piston rod 28 of the rear piston-cylinder drive 26 is retracted. The piston rod 27 of the front drive 25 stays in the retracted position. Simultaneously, the piston-cylinder drive 32 of the restoring and strap braking means 31 is activated and extended. The two braking plungers 33, 34 enter the strap guiding channel 8 and, by their frontal ends, lift the looping strap 4 upwards. The entering motion of the braking plungers 33, 34 reaches so far that, with the looping strap 4 forming an intermediary, they contact the bottom side 44 of the braking jaw 35 of the rocker 23, thus moving the rocker into a straight position (FIG. 4). In this position, both pressing rollers 21, 22 are spaced from the driving rollers 10, 11 so that no driving powers act on the looping strap 4. The looping strap is stopped abruptly as a result of the simultaneous braking effect of the braking plungers 33, 34.

For withdrawal of the strap, the piston-cylinder drive 32 is retracted so that the braking plungers 33, 34 will release the looping strap 4 and the braking jaw 35—and thus the rocker 23. Simultaneously, the piston rod 27 of the piston-cylinder drive 25 is moved into the extended position. In this way the rocker 23 is tilted clockwise and the pressing roller 22 is set to the driving roller 11. Correspondingly, the looping strap 4 is withdrawn in the direction of withdrawal 50 (FIG. 5) and the loop of strap is conventionally fitted tightly around the product stack to be looped.

Summing up, it can be said that prompt reversal of the strap drive is rendered possible by simple triggering of the three piston-cylinder drives 25, 26 and 32. Owing to the alternate triggering, the rocker 23 actuating means needs no restoring elements such as screws, springs or the like.

Figure 6:
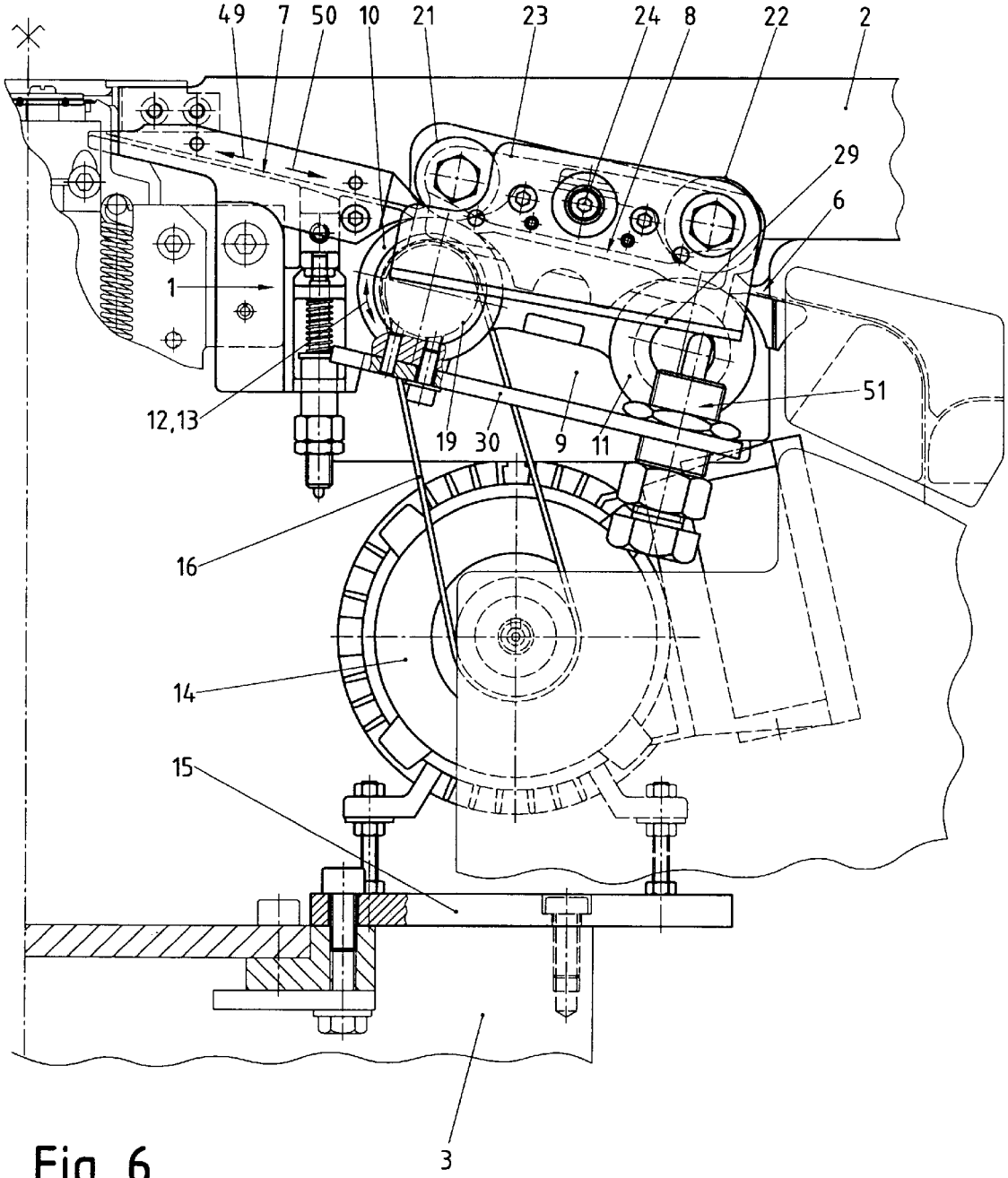
FIG. 6 is a lateral view of a second, simplified embodiment of a strap driving device by analogy to FIG. 1.

FIG. 6 shows a simplified embodiment of the strap driving device 1. It shows that the strap driving device according to the invention can be designed in modular system and can be retrofitted depending on the requirements. If for instance no extremely rapid change between insertion and withdrawal by strap braking is necessary, a conventional pair of drive rollers will do, comprising the driving roller 10 and the pressing roller 21. The two other rollers 11, 22 can be integrated for strap guidance without having any other function.

As seen in FIG. 6, only the driving roller 10 is driven by a belt 16, the electric motor 14 being able to work reversibly. The roller 11 revolves freely. As compared with the embodiment of FIGS. 1 to 5, the rocker 23 is unchanged, it is only actuated counter-clockwise by a compression-spring arrangement 51 instead of the rear piston-cylinder drive 26. Consequently, the pressing roller 26 is permanently set to the driving roller 10 so that the intermediate looping strap 4 is transported in the direction of insertion 49 or withdrawal 50, depending on the direction of rotation 12, 13 of the driving roller 10. The combined restoring and strap braking device and the further piston-cylinder drives 26, 32 thus can also be omitted. Otherwise all the identical components also used in the embodiment according to FIG. 6 are denoted by the same reference numerals as in FIGS. 1 to 5 and need no renewed explanation.

Figure 7:
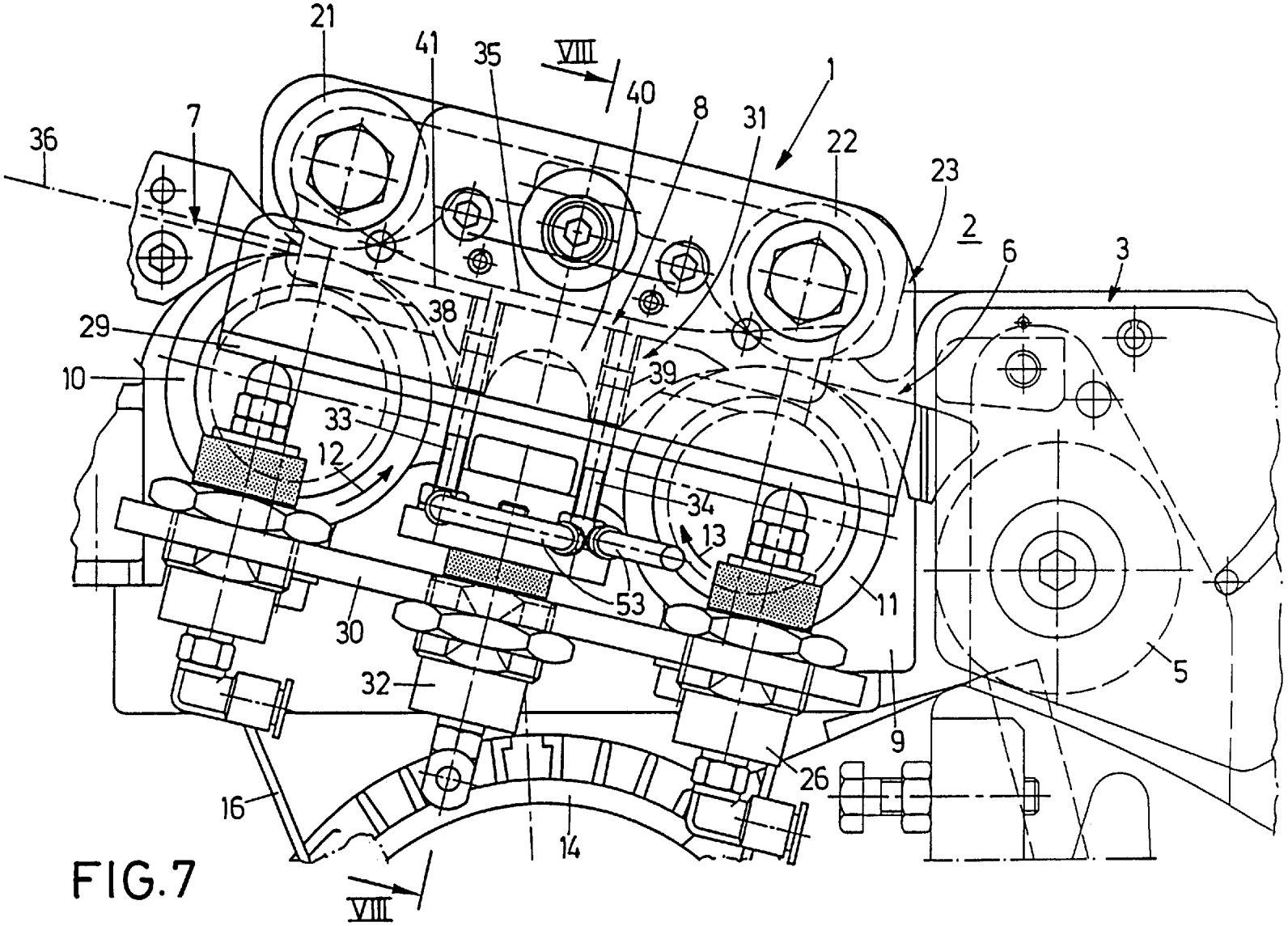
FIG. 7 is a lateral detail view, on an enlarged scale, of a third embodiment of a strap driving device.
Figure 8:
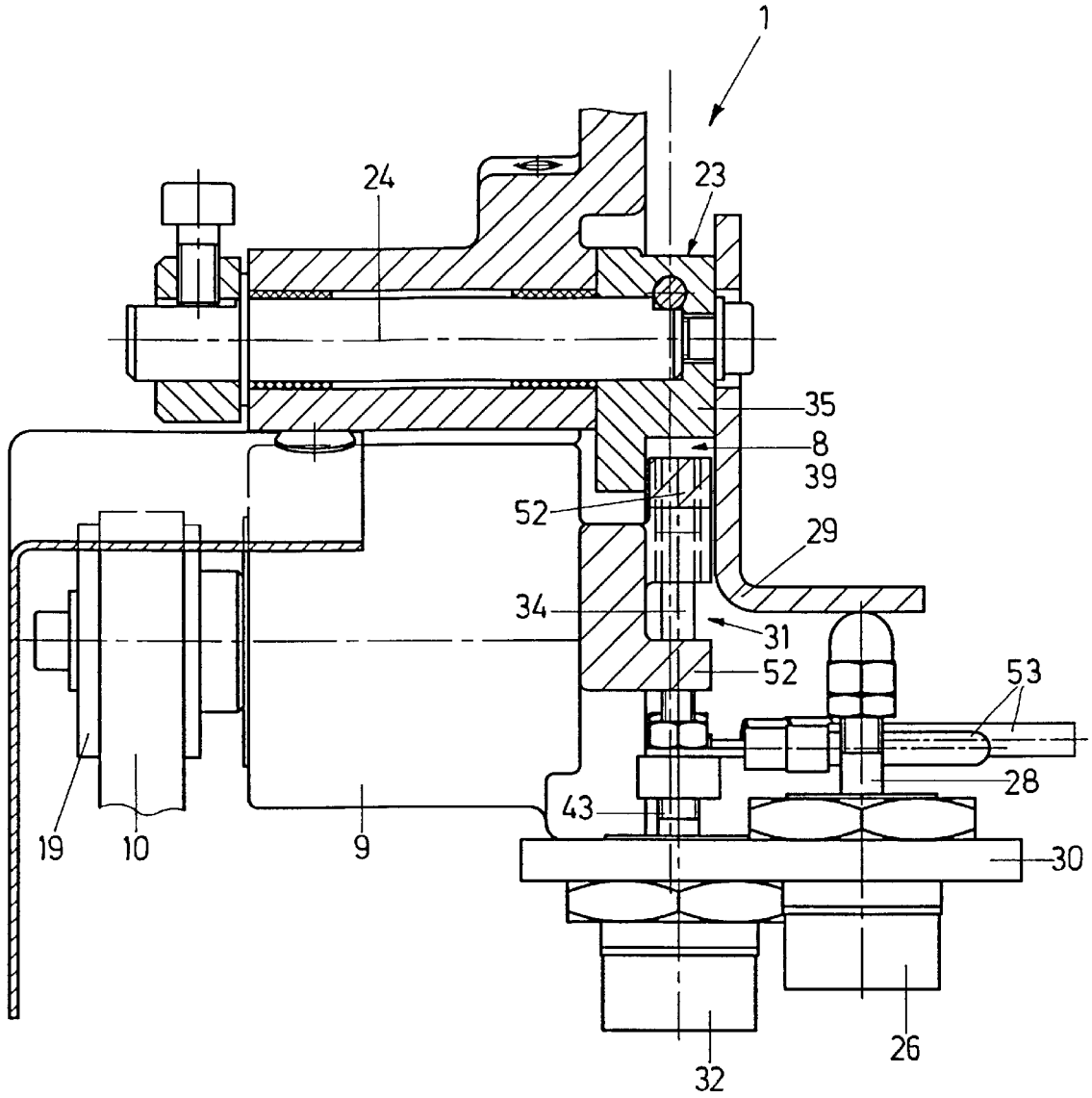
FIG. 8 is a section on the line A—A according to FIG. 7.

This is also true for the further embodiment of the strap driving device according to FIGS. 7 and 8. Again, the following is an explanation only of the differences from the exemplary embodiments specified above, which in the present case relate to the strap scanner. While a light-optical scanner is used in the embodiment according to FIGS. 1 to 5, the embodiment according to FIGS. 7 and 8 makes use of an electrically operating strap scanner. To this end, the two braking plungers 33, 34 are housed for displacement in electrically insulated guides 52 (FIG. 8) and connected with an extra-low voltage terminal via connecting lines 53 (for instance 24 V d.c. voltage). Thus the two braking plungers 33, 34 function as a positive pole and are insulated towards the basic machine body. The latter and in particular the braking jaw 35, against which the two braking plungers 33, 34 work, function as a negative pole or ground. If the looping strap 4 is threaded regularly and the strap braking means takes action, the insulating looping strap lies between the braking plungers 33, 34 and the braking jaw 35. Consequently, there is no contact between the positive and negative pole of the electric contact device, which is detectable by a corresponding inquiry from the control of the strap driving device. If the looping strap 4 is inadvertently pulled out of the strap guiding channel 8, each braking plunger 33, 34 contact the braking jaw 35 upon actuation of the strap braking means. An electric contact is closed, which leads to current conduction detectable by the control and to a correspondingly acceptable electrical error signal.

What is claimed is:

1. A strap driving device for looping machines, comprising a strap guiding channel (8) for a looping strap (14), and two pairs of drive rollers (10, 21; 11, 22), engaging in the strap guiding channel (8) and each pair of rollers having a driving roller (10, 11) driven in rotation and a pressing roller (21, 22) to be set to the latter for free running, each driving roller (10, 11) being stationary and each pressing roller (21, 22) being mounted on a rocker (23) for the purpose of being set to the associated driving roller (10, 11) and the driving rollers (10, 11) being disposed successively on the strap guiding channel (8), and the pressing rollers (21, 22) being disposed on a joint rocker (23) for alternate setting, wherein the rocker (23) comprises a combined restoring and strap braking means (31), which lifts the looping strap (4) off the respective driving roller (10, 11) and simultaneously moves the rocker (23) into a neutral position in which, while the looping strap (4) is braked, none of the pressing rollers (21, 22) acts upon the looping strap (4).

2. A strap driving device according to claim 1, wherein the two driving rollers (10, 11) are driven permanently in opposite direction of rotation (12, 13).

3. A strap driving device according to claim 1, wherein the restoring and strap braking means (31) is constituted by two braking plungers (33, 34) which are disposed one after the other in a strap traveling direction (49, 50) and engage before and behind an axis of rotation (24) of the rocker (23) and which lift the looping strap (4) off the driving rollers (10, 11) and press it against a braking jaw (35) mounted on the rocker (23), simultaneously moving the rocker (23) into its neutral position.

4. A strap driving device according to claim 3, wherein the two braking plungers (33, 34) are jointly drivable by a piston-cylinder drive (32).

5. A strap driving device according to claim 3, wherein an electrically operating contact scanner as strap scanner for the detection of the presence of a looping strap (4) is integrated in the strap driving device, and wherein said electrically operating contact scanner is constituted by said braking plungers (33, 34) which are mounted in a manner electrically insulated and under extra-low voltage towards the remaining components of the strap driving device so that upon contact between the braking plungers (33, 34) and the braking jaw (35), an electric signal can be produced when the looping strap (44) is missing.

6. A strap driving device according to claim 1, comprising two piston-cylinder drives (25, 26) working in opposite directions and being associated to the rocker (23) for alternate actuation of said rocker (23).

7. A strap driving device according to claim 1, wherein the rocker (23) is permanently actuated in one direction for the durable setting of a pressing roller (21) to a driving roller (10) and wherein this driving roller (10) is reversibly drivable.

8. A strap driving device according to claim 1, further comprising a strap scanner for the detection of the presence of said looping strap (4).

9. A strap driving device according to claim 8, wherein the strap scanner is a light barrier unit which comprises a light guide (45) for guidance of a scanning beam to a breaker gap (U1, U2) positioned in the strap guiding channel (8).

10. A strap driving device according to claim 9, wherein the light guide (45) is guided several times over the strap guiding channel (8), forming several breaker gaps (U1, U2).

11. A strap driving device according to claim 8, wherein the strap scanner is an electrically operating contact scanner.

12. A strap driving device for looping machines comprising a strap guiding channel (8) for a looping strap (14), and at least one pair of drive rollers (10,21; 11,22), engaging in the strap guiding channel (8) and having a driving roller (10, 11) driven in rotation and a pressing roller (21,22) to be set to the latter for free running, the driving roller (10, 11) being stationary and the pressing roller (21,22) being mounted on a rocker (23) for the purpose of being set to the driving roller (10, 11), wherein a strap scanner is integrated in the strap driving device (1) for the detection of the presence of a looping strap (4), which strap scanner is a light barrier unit, which comprises a light guide (45) for guidance of a scanning beam to a breaker gap (U1, U2) positioned in the strap guiding channel (8).

13. A strap driving device according to claim 12, wherein the light guide (45) is guided several times over the strap guiding channel (8), forming several breaker gaps (U1, U2).

14. A strap driving device according to claim 12 wherein there are two spaced pairs of drive rollers, said light guide and said breaker gap are positioned between said two spaced pairs of drive rollers.

* * * * *